United States Patent [19]

Terauchi

[11] Patent Number: 4,955,922

[45] Date of Patent: Sep. 11, 1990

[54] URINE-COLLECTING APPARATUS FOR WHEEL-CHAIR

[76] Inventor: Ryugo Terauchi, 1019-359 Kuden-cho, Sakae-ku, Yokohama Kanagawa Pref., Japan

[21] Appl. No.: 455,302

[22] Filed: Dec. 22, 1989

Related U.S. Application Data

[63] Continuation of Ser. No. 287,717, Dec. 20, 1988, abandoned, which is a continuation of Ser. No. 183,001, Apr. 18, 1988, abandoned, which is a continuation of Ser. No. 863,112, Jul. 21, 1986, abandoned, which is a continuation of Ser. No. 644,313, Aug. 24, 1984, abandoned.

[51] Int. Cl.[5] ..... A47K 11/02

[52] U.S. Cl. ..... 4/480; 297/DIG. 4

[58] Field of Search ..... 4/480, 474, 144.1–144.3; 297/DIG. 4, 453; 604/327, 329, 349–353, 368

[56] References Cited

U.S. PATENT DOCUMENTS

| | | | |
|---|---|---|---|
| 588,829 | 8/1897 | Johnson | 4/480 |
| 801,117 | 10/1905 | Stow | 4/480 X |
| 3,261,031 | 7/1966 | Gates | 4/480 X |
| 3,568,217 | 3/1971 | Anderson | 4/144.1 |
| 3,611,457 | 10/1971 | Wippich | 4/480 |
| 3,697,127 | 10/1972 | Robertson | 297/DIG. 4 X |
| 4,281,655 | 8/1981 | Terauchi | 128/278 |
| 4,296,506 | 10/1981 | Stoute et al. | 4/480 |
| 4,365,363 | 12/1982 | Windauer | 4/480 X |

FOREIGN PATENT DOCUMENTS

| | | | |
|---|---|---|---|
| 0041037 | 12/1981 | European Pat. Off. | 297/DIG. 4 |
| 2132741 | 1/1973 | Fed. Rep. of Germany | 297/453 |
| 0946215 | 1/1964 | United Kingdom | 297/453 |

*Primary Examiner*—Charles E. Phillips

*Attorney, Agent, or Firm*—Bernard L. Kleinke; William Patrick Waters; Jerry R. Potts

[57] ABSTRACT

A urine-collecting apparatus for a wheel-chair is detachably incorporated in a wheel-chair or special-purpose chair at a portion under a seat part thereof. The central portion of the front part of a seat of the wheel-chair or special-purpose chair is cut in a U shape. A tube is passed through the cut part in the seat. The tube provides a communication between a urine-receiving part previously attached to the genital part of special-purpose underpants or drawers worn by a user of the wheel-chair or special-purpose chair and a urinal-tank. Moreover, a urinal-case is installed on the underside of a seat-plate at the cut part. Thus, the user can readily urinate while taking a seated posture.

6 Claims, 2 Drawing Sheets

FIG. 1
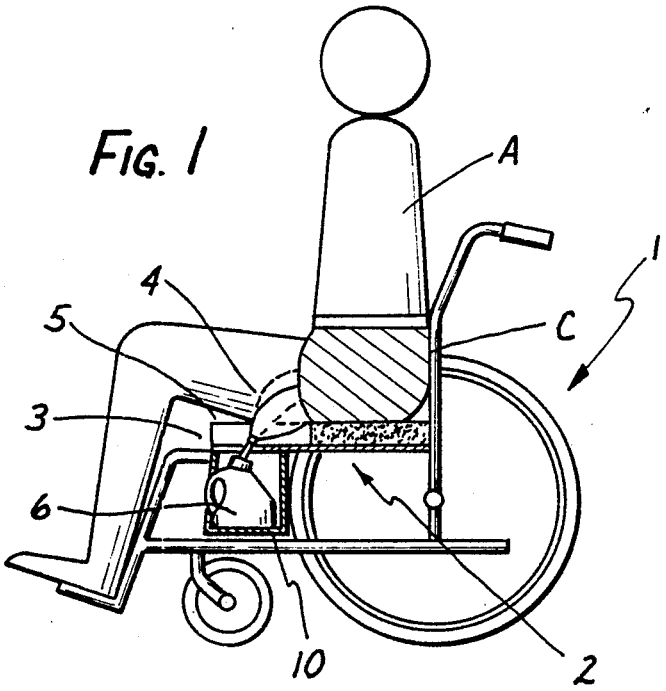
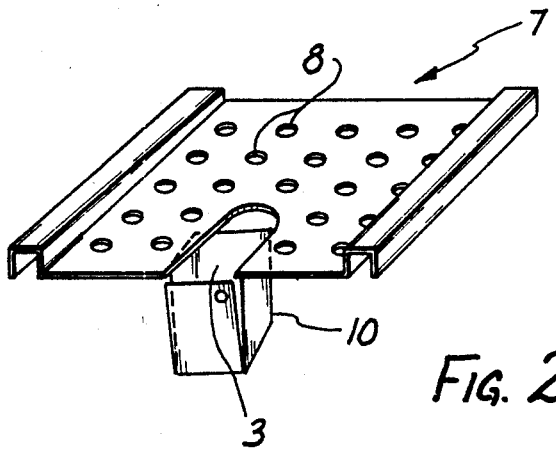
FIG. 2

URINE-COLLECTING APPARATUS FOR WHEEL-CHAIR

This is a continuation of pending prior application Ser. No. 07/287,717, filed Dec. 20, 1988, now abandoned, of Ryugo Terauchi for Urine Collecting Apparatus for Wheel Chair; which was a continuation of prior application Ser. No. 07/183,001, filed Apr. 18, 1988, now abandoned, which was continuation of prior application Ser. No. 06/863,112, filed Jul. 21, 1986, now abandoned, which was a continuation of prior application Ser. No. 06/644,313, filed Aug. 24, 1984, now abandoned.

BACKGROUND OF THE INVENTION

The present invention relates to a urine-collecting apparatus for use in a wheel-chair or special-purpose chair.

Urination is a serious matter for spine-injured-patients, incontinent patients, elderly people and convalescents undergoing rehabilitation who must use wheel-chairs or special-purpose chairs for a long period of time in their daily lives. However, no consideration has been taken so far for any urine-collecting means useful for the above-mentioned patients and people in their wheel-chairs or special-purpose chairs.

SUMMARY OF THE INVENTION

Accordingly, a primary object of the invention is to provide a urine-collecting apparatus for use in a wheel-chair which is very useful for wheel-chair users.

To this end, according to the invention, there is provided a urine-collecting apparatus for a wheel-chair which is detachably incorporated in a wheel-chair or special-purpose chair at a portion under a seat part thereof, the urine-collecting apparatus comprising: a U-shaped cut-out portion formed in the central portion in the front part of a seat of the wheel-chair or special-purpose chair; a tube extending through the cut-out portion in the seat, the tube providing a communication between a urine-receiving part previously attached to the genital part of special-purpose underpants or drawers worn by a user of the wheel-chair or special-purpose chair, and a urinal-tank; and a urinal-case installed on the underside of a seat-plate at the cut-out portion, whereby the user can readily urinate while taking a seated posture.

The urine-collecting apparatus in accordance with the invention permits spine-injured-patients, incontinent patients, elderly people and convalescents undergoing rehabilitation who must use wheel-chairs or special-purpose chairs for a long period of time in their daily lives, to readily urinate regardless of whether they urinate consciously or unconsciously, and makes it possible to collect urine easily. Moreover, according to the invention, a spongy cushion excellent in both air permeability and ventilation from the upper surface to the lower surface thereof, is mounted on the seat at the seat part of the wheel-chair or special-purpose chair, thereby to prevent skin-sores around the bumps of the bones in the users' buttocks which are easily caused through the use of the wheel-chairs or special-purpose chairs over a long period of time.

The above and other objects, features and advantages of the invention will become clear from the following description of the preferred embodiment thereof taken in conjunction with the accompanying drawings.

BRIEF DESCRIPTION OF THE DRAWINGS

FIG. 1 is a partly-sectioned side elevational view of a wheel-chair employing the urine-collecting apparatus in accordance with the invention, said sectioning taken along line 1—1 of FIG. 2 and showing the urinal-case of the apparatus with a urinal tank therein for illustration purposes.

FIG. 2 is a pictorial view of a seat-plate fitted on a chair frame;

DESCRIPTION OF THE PREFERRED EMBODIMENT

Figure 3:
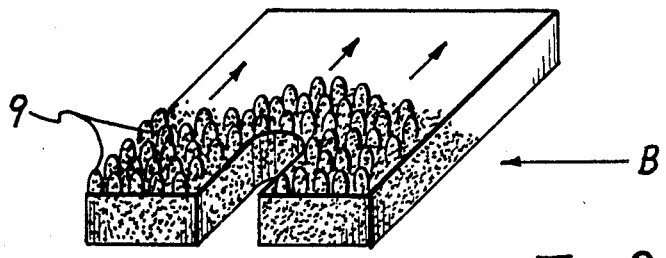
FIG. 3 is a pictorial view of a spongy cushion mounted on the upper surface of the seat-plate shown in FIG. 2.

The invention will be described hereinafter with reference to the accompanying drawings.

Referring first to FIG. 1 which is a partly-sectioned side elevational view of a wheel-chair employing the urine-collecting apparatus in accordance with the invention, a central cut-out portion 3 in the front part of a seat 2 of a wheel-chair 1 to provide a U shape in order to collect the urine passed by a wheel-chair user A in a urinal-tank 6 through a tube 5 from a urine-receiving part 4 previously attached to the genital part of the user A.

The urinal-tank 6 is housed in a urinal-case 10 installed on the under side of a seat-plate 7. As shown in FIGS. 1 and 2, the urinal-case 10 includes a backwall 20, a pair of side walls 21 and 22 a base plate 23, and an access opening 16. The access opening 16 extends over substantially the entire top portion of the urinal-case 10 through which extends the tube 5 between the urine receiving part 4 and the urinal-tank 6. The access opening 16 in the urinal-case 10 having a cross-sectional area of sufficient dimension to permit the urinal tank 6 to be inserted into or removed from the interior of the urinal-case 10.

Figure 4:
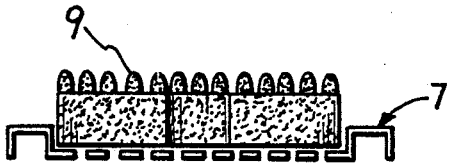
FIG. 4 is a sectional view of the spongy cushion mounted on the upper surface of the seat-plate.

Referring now to FIG. 2 which shows the seat-plate 7 for the seat 2, the seat-plate 7 fitted on the frame of the wheel-chair 1 is provided with a multiplicity or plurality of small bores or holes 8 to obtain an excellent air permeability for aiding in the prevention of skin-sores on the user's buttocks, which sores are easily caused through the use of the wheel-chair 1 for a long period of time. In addition, a spongy resilient cushion B which is excellent in both air permeability and ventilation from the upper surface to the lower surface thereof as well as having on its upper surface, a multiplicity of protrusions 9. As shown in FIG. 3, the cushion B is wrapped with a washable cover and is then mounted on the upper surface of the seat-plate 7. FIG. 4 is a sectional view of the cushion B, shown mounted on the upper surface of the seat-plate 7.

The urine-collecting apparatus of the invention constructed as above positively helps the rehabilitation of people who must use wheel-chairs or special-purpose chairs over a long period of time. In addition, the urine-collecting apparatus relieves spine-injured or disabled persons of their anxieties about urination when they are out. Moreover, the urine-collecting apparatus makes it possible to prevent skin-sores, and also has an extremely useful for incontinent patients and the like.

As has been described, the invention conveniently permits the wheel-chair users to pass urine, including incontinent urine, while assuming a seated relaxed posture, which has thus far been unknown in the art, and is useful in preventing skin-sores, advantageously.

Although the invention has been described through specific terms, it is to be noted here that the described embodiment is not exclusive and various changes and modifications may be imparted thereto without departing from the scope of the invention which is limited solely by the appended claims.

What is claimed is:

1. A urine-collecting apparatus for a wheel-chair or a special purpose chair comprising:

a seat-plate;

said seat-plate having a pair of parallel spaced apart U-shaped rails for attaching said seat-plate to the frame of the wheel-chair or special purpose chair, said rails being spaced apart by an integrally connected flat plate having an upperside and an underside as well as a front and rear edge, said plate supporting an occupant thereon;

said flat plate having a central front portion including a short generally U-shaped elongated cut-out intersecting said front edge, said cut-out being disposed forwardly and generally beneath the position of the genitals of an occupant seated on said plate;

a spongy air permeable cushion disposed on said flat plate for helping to cushion the buttocks of said occupant, said spongy cushion having a central front portion including a short generally U-shaped elongated cut-out disposed forwardly in overlying registration with said short cut-out in said flat plate;

a urine-receiving part adapted to be attached at one end to the genital part of special-purpose underpants or drawers worn by a user of said wheel-chair or special-purpose chair and attached at its opposite end to one end of a relatively short tube, said tube being attached at its other end to a removable closed urinal tank;

a urinal case attached on the underside of said flat plate under said flat plate cut-out for housing said removable closed urinal tank;

said urinal case including means defining an opening aligned with said cut-outs for enabling said tube to extend therethrough to provide fluid communication between said urine-receiving part and said urinal tank to permit urine to flow to the urinal tank under the force of gravity;

said means defining placement of opening further enabling an said urinal tank inside said urinal case, and removal therefrom for disposing of said tank contents, in a convenient manner; and whereby said occupant can readily urinate into said urine-tank through said urine-receiving part, without disrobing and without assistance, while assuming a seated posture with the tube operationally attached between the urine-receiving part and the urinal tank by insertion of said tube through said U-shaped cut-outs and into said urinal tank.

2. A urine-collecting apparatus according to claim 1, wherein said seat plate includes means defining a plurality of small holes to provide for air permeability to aid in the prevention of skin sores.

3. A urine-collecting apparatus according to claim 2, wherein said cushion includes a plurality of protrusions on the upper surface thereof to further facilitate air permeability and ventilation.

4. A urine-collecting apparatus according to claim 3, further including a washable cover enveloping said cushion.

5. A urine-collecting apparatus according to claim 1, wherein said rails include a pair of parallel upstanding projections for receiving said cushion therebetween.

6. A urine-collecting apparatus according to claim 5, wherein said projections are channel-shaped throughout their lengths and are integrally connected to the margin edges of said seat portion.

* * * * *